United States Patent [19]

Sharon

[11] 4,193,649

[45] Mar. 18, 1980

[54] ANTI-TILT BRACKET AND CLIP ASSEMBLY FOR ADJUSTABLE DRAWERS OR SIMILAR ARTICLES

[76] Inventor: Zev Sharon, 1447 Kimberly Dr., Lakewood, N.J. 08701

[21] Appl. No.: 5,603

[22] Filed: Jan. 22, 1979

[51] Int. Cl.[2] ..... A47B 88/00; A47G 29/02

[52] U.S. Cl. ..... 312/346; 312/347; 248/243; 248/248

[58] Field of Search ..... 312/346, 347, 343, 344; 248/248, 243

[56] References Cited

U.S. PATENT DOCUMENTS

| | | | |
|---|---|---|---|
| 1,798,876 | 3/1931 | Geimer | 312/346 |
| 1,852,598 | 4/1932 | Vogt | 248/243 |
| 1,853,018 | 4/1932 | Knape | 248/243 |
| 2,142,897 | 1/1939 | Harmon | 312/343 |
| 2,803,352 | 8/1957 | Smola et al. | 248/243 |
| 2,857,233 | 10/1958 | Reiss et al. | 312/347 |
| 2,928,512 | 3/1960 | Slater et al. | 248/243 |
| 3,294,466 | 12/1966 | Marateck et al. | 312/343 |
| 3,851,943 | 12/1974 | Afful | 312/347 |
| 3,895,774 | 7/1975 | Sharp | 248/243 |
| 4,101,108 | 7/1978 | Klein | 248/243 |

FOREIGN PATENT DOCUMENTS

| | | | |
|---|---|---|---|
| 1426560 | 3/1976 | United Kingdom | 248/243 |

*Primary Examiner*—Victor N. Sakran
*Attorney, Agent, or Firm*—Arthur L. Plevy

[57] ABSTRACT

A bracket and clip apparatus for slidable recessed drawers comprises a bottom portion having a first transverse projection for coacting with a slot in a typical wall bracket. The transverse projection extends from a medial region of a bottom portion of the clip with the region having an arcuate section terminating in a second projection for coacting with another slot in the bracket. Located on said medial region is an upstanding bracket flange for accommodating and supporting a slidable channel assembly. A counterbalance member is positioned about the upstanding flange and the wall bracket to prevent tilting of the clip and bracket assembly to restrain the projections from disengaging the slots during operation of a drawer or similar article coupled to said slidable channel assembly.

8 Claims, 8 Drawing Figures

ANTI-TILT BRACKET AND CLIP ASSEMBLY FOR ADJUSTABLE DRAWERS OR SIMILAR ARTICLES

BACKGROUND OF INVENTION

This invention relates to a bracket assembly and more particularly to a bracket assembly coacting with a track for adjusting the height of a drawer or similar article.

The prior art is replete with a number of adjustable bracket devices which essentially, comprise clips which can be moved with respect to a bracket. The brackets typically have a plurality of holes or slots on the surface and are used to adjust the height of a shelf as a bookcase or similar article. Such brackets and clip assemblies vary greatly in regard to adjustable shelves and many versions of the same are available in the prior art.

As one can ascertain, based on the operation of such devices, the clips can be removed from the bracket by tilting the same and hence, disengaging the projections on the clip from the slots in the bracket. When the clips are disposed in the slots of the bracket, a downward force such as the weight of a shelf and so on, firmly secures the clip within the bracket and hence, prevents accidental or inadverent dislodging of the clip from the bracket.

A substantial problem exists in formulating a suitable bracket for a recessed drawer or similar article which is slidably mounted with respect to a cabinet or other item. First, there is a need for providing a universally adjusted drawer or similar article for employment in various cabinets used in the home or on commercial premises. The drawer or slidable shelf is usually positioned within the confines of a cabinet and can be opened or withdrawn as desired. Based on present needs, it is also desirable to have the location of the drawer adaptable with respect to the enclosure to enable one to optimumly employ the cabinet space.

It is therefore an object of the present invention to provide a bracket or clip assembly for adjustable drawers or similar articles; which clip assembly includes means for preventing the inadvertent dislodging of the clip or bracket assembly during normal operation.

BRIEF DESCRIPTION OF PREFERRED EMBODIMENT

A bracket and clip apparatus for slidable recessed drawers or similar articles comprising in combination a surface bracket having a plurality of slots on a surface thereof, said slots separated one from the other by a predetermined distance, a clip and bracket assembly comprising a bottom portion havng a first transverse projection for coacting with any given one of said slots in said bracket, said transverse projection extending from a medial region of said bottom portion with said medial region having a downward arcuate section terminating in a second projection located relatively in the same plane as said first projection to coact with another slot in said bracket with said medial region extending relatively transverse to said bracket when said projections are accommodated by said slots, an upstanding bracket flange positioned on said medial region at a given distance from said first projection and adapted to support a slidable channel assembly, a counterbalance member positioned about said upstanding flange and said wall bracket to prevent tilting of said clip and bracket assembly to thereby prevent said projections from inadvertently disengaging from said slots when said bracket flange is supporting a slidable channel assembly.

DETAILED DESCRIPTION OF THE INVENTION

Referring to FIGS. 1A to 1D, there is shown respectively a side view (FIG. 1A), a rear view (1B), a bottom view (1C), and a top view (1D) of a clip and bracket assembly according to this invention.

Figure 1A:
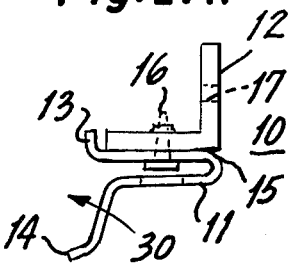
FIGS. 1A to 1D are side, front, rear and top views of a clip and bracket assembly according to this invention.
Figure 1B:
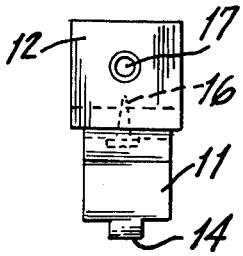
Figure 1C:
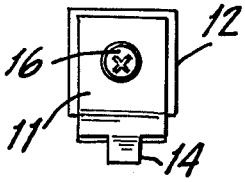
Figure 1D:
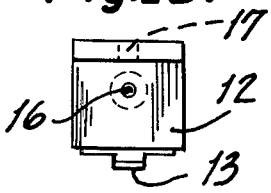

As shown in FIG. 1A, a bracket assembly 10 consists of a lower section 11 and an upper section 12. Section 11 is a conventional clip which is employed in the prior art for an adjustable shelf arrangement. The clip 11 has a top projection 13 consisting of an upstanding flange for insertion into a bracket slot.

A bottom projection 14 extends at a transverse angle sloping downwardly with respect to projection 13 and is also deployed for coacting with an adjacent slot in a bracket. The central portion of the clip 11 is of a C-shaped configuration and has a top area 15 which is relatively flat for supporting the edges of a shelf. The clip section 11 is made from a strong springy material such as steel or another suitable alloy.

Shown secured to the flat top surface 15 of section 11 is an L-shaped bracket 12. The bracket 12 is secured to the flat top portion of the clip 11 by means of a screw 16 or other suitable fastening device.

It is noted that the bracket and clip assembly is shown as a composite structure in FIGS. 1A to 1D, but it is obvious that the unit depicted can be integrally made as a single assembly without departing from the teachings of the invention. Many techniques for forming a bracket for similar operation should become apparent to those skilled in the art upon viewing FIGS. 1A to 1D.

The bracket 12 as seen, is a right angle or L-shaped bracket having an aperture 17 located on the upstanding flange. The aperture 17, as will be explained, is used for insertion of a screw or similar fastener to enable one to couple the bracket 12 and hence, the clip assembly to a slide mechanism for coupling to a slidable drawer or similar article.

Figure 2:
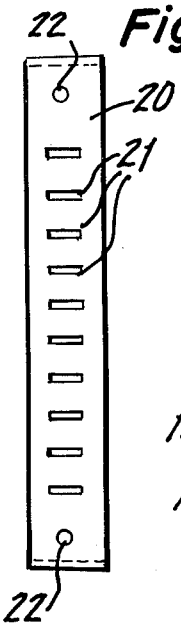
FIG. 2 is a front view of an adjustable bracket.

Shown in FIG. 2 is a typical wall bracket 20. The bracket 20 has a plurality of slots or apertures 21 located on the surface thereof and separated one from the other by a predetermined distance. Such brackets as indicated above, are known and available in the art and are used for providing adjustable height to shelves such as in bookcases or similar articles. The bracket 20 has additional apertures such as 22 for mounting the same on the sidewalls of a bookcase and so on for coacting with clip sections, such as section 11 employed for support of such shelves.

Hence, as can be ascertained, the projections 13 and 14 of section 11 are inserted into suitable slots as 21 of the bracket 20. The flat central area 15 as extending from the bracket 20 is used to support the edges of a shelf.

Before proceeding with a description of the invention, it can be seen that in order to remove a section or clip as 11 from a bracket as 20, one pushes the clip in the direction of arrow 30 of FIG. 1A or tilts the clip to disengage projections 14 and 13 from the associated slots and hence, the clip can be moved to coact with any particular slots as desired to thereby enable one to adjust the height of the shelf.

If such a clip as shown in FIG. 1A were employed in conjunction with the bracket of FIG. 2 to provide an adjustable drawer or slidable shelf, the normal operation of withdrawing or sliding the unit coupled to the clip would dislodge the clip from the bracket and hence, cause the drawer or shelf coupled thereto to become disengaged due to the fact that the clip sections as 11 would be continuously withdrawn from the slots on the bracket 20.

Figure 3:
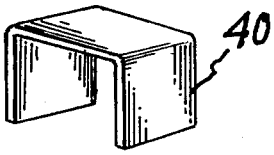
FIG. 3 is a perspective view of a counterbalance member employed with this invention.

Referring to FIG. 3, there is shown a counterbalance or anti-tilt member 40. The member 40 is a U-shaped member having first and second sides which are contiguous with a top central surface. Member 40 is inserted over the composite clip assembly as shown in FIGS. 1A to 1D, hence preventing the clip assembly from tilting during the slidable operation of a recessed drawer or other assembly.

The mechanism thus described enables one to provide an adjustable height for a slidable drawer or shelf located within a cabinet or other unit. It is simple, inexpensive and both easy to operate and to install.

Figure 4:
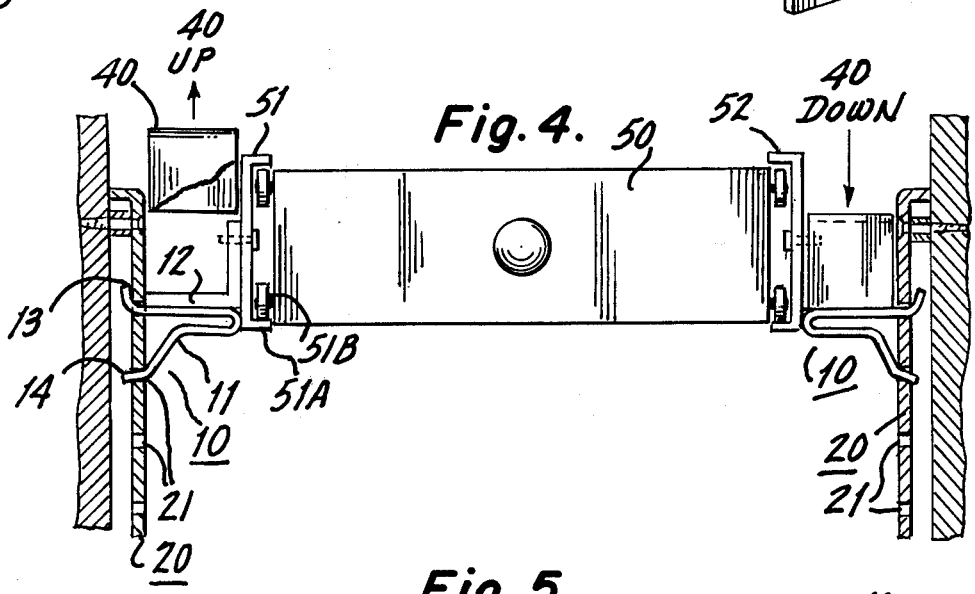
FIG. 4 is a front view depicting a slidable drawer or shelf having an adjustable height capability employing a bracket and clip assembly according to this invention.

Referring to FIG. 4, there is shown a drawer or shelf assembly 50. Coupled to each side of the assembly are bracket arrangements 51 and 52. The brackets 51 and 52 are conventional in the prior art and essentially comprise a fixed channel section such as 51A which is coupled to a suitable roller or slide assembly such as 51B coupled to the sides of the drawer. The channel 51A is secured to section 12 of the bracket assembly 10 by a suitable fastener inserted into aperture 17.

Figure 5:
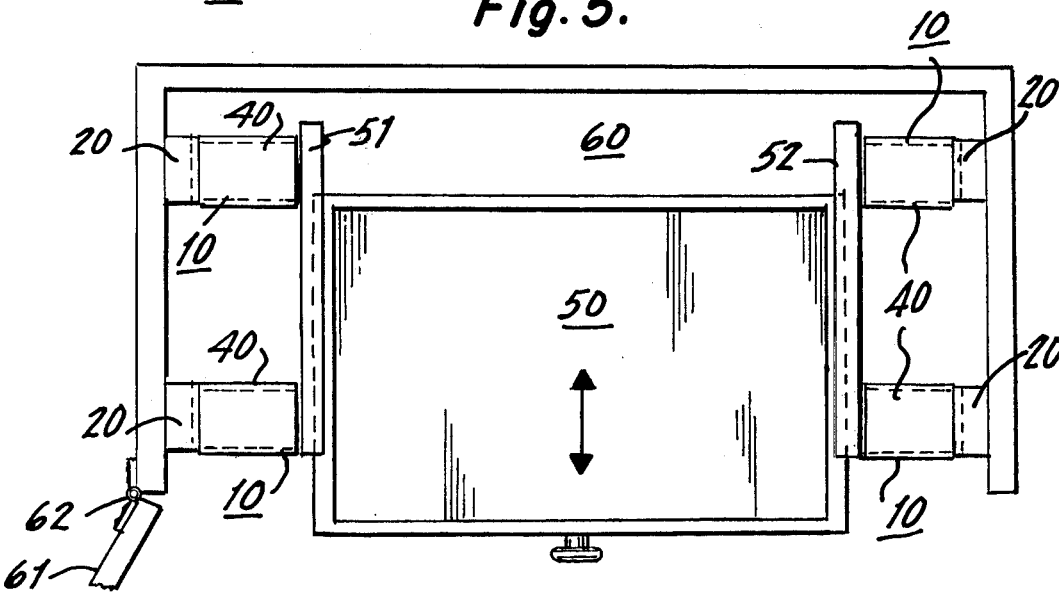
FIG. 5 is a top view of the assembly depicted in FIG. 4.

Referring to FIG. 5, there is shown a top view indicating that two bracket assemblies such as 10 may be employed to support a drawer via the channels 51 and 52. The mechanisms for providing slidable operation of a drawer or similar assembly such as assemblies 51 and 52 are known in the art and most modern day drawers employ such apparatus.

Shown in FIG. 4 are brackets as 20 of FIG. 3 which are mounted on suitable sidewalls of the enclosure or cabinet in which a drawer 50 is positioned. The projections 13 and 14 of the clip of bracket assembly 10 are inserted into appropriate slots as 21 associated with bracket 20 both at the left and the rights sides to determine a suitable height for the drawer assembly. Thus as can be seen, the brackets support the channels 51 and 52 within the enclosure to enable one to slide the drawer.

As seen in FIG. 5, the enclosure 60 which may be the hollow confines of a cabinet may have a door 61 coupled to a sidewall of the enclosure by means of a hinge assembly 62. It is seen from FIGS. 4 and 5 that the dimensions of the clip provide automatic clearance in regard to the hinge assembly and hence, the installer does not have to worry about clearing the hinge as the clip or bracket assembly 10 affords this operation automatically. The top section 15 of the clip is between $\frac{3}{4}$ and 1 inch in length and this distance provides hinge clearance and so on.

Once the brackets are installed as shown in FIGS. 4 and 5, the member 40 is inserted over the bracket assembly and between the L-shaped section 12 and the front surface of the bracket 20.

Shown in FIG. 4 at the left side is a member 40 about to be placed in position. The member 40 is shown in position on the right side. By positioning the member 40 as depicted, one prevents the clip assembly comprising sections 11 and 12 from tilting in a direction which would remove the clip projections from the brackets 20. Hence, a user can now open and close the drawer as many times as desired without fear that the clips will become disengaged from the brackets 20. If one desires to change the height or the level at which the drawer or slidable shelf is positioned, one merely removes the members 40 to gain access to the clip sections which can then be removed by tilting the same and the entire assembly positioned in various other slots as 21 associated with the brackets 20.

While the apparatus depicted appears rather simple in construction and appearance, it functions extremely reliably and solves a problem which has long existed in the cabinet art. The brackets, as one can ascertain, are simple to install and operate and inexpensive to manufacture.

As above indicated, the clip mechanism shown in FIGS. 1A to 1D can be integrally formed in lieu of the composite structure depicted herein. The member 40 serves a dual purpose in that it acts as a counterbalance to prevent tilt of the clip section during operation of the drawer or shelf coupled thereto and further acts to enhance the aesthetic appearance of the entire structure by providing an attractive cover member for the composite clip assembly to thus further enhance the aesthetic appearance of the cabinet design.

It would be appreciated that many modifications can be made to the apparatus without departing from the spirit and scope of the invention as above described and as represented by the appended claims.

I claim:

1. A bracket and clip apparatus for slidable recessed drawers or similar articles comprising in combination:

(a) a surface bracket having a plurality of slots on a surface thereof, said slots separated one from the other by a predetermined distance, (b) a clip and bracket assembly comprising a bottom portion having a first transverse projection for coacting with any given one of said slots in said bracket, said transverse projection extending from a medial region of said bottom portion with said medial region having a downward arcuate section terminating in a second projection located relatively in the same plane as said first projection to coact with another slot in said bracket with said medial region extending relatively transverse to said bracket when said projections are accommodated by said slots, an upstanding bracket flange rigidly secured to said medial region at a given distance from said first projection and adapted to support a slidable channel assembly, (c) a counterbalance, member positioned about said upstanding flange and said surface bracket to prevent tilting of said clip and bracket assembly to thereby prevent said projections from inadvertently disengaging from said slots when said bracket flange is supporting a slidable channel assembly.

2. The apparatus according to claim 1 wherein said counterbalance member comprises a U-shaped member having a central portion with first and second side portions depending therefrom and of a width determined by the distance between said first projection and said upstanding flange for insertion in the space therebetween to thereby prevent tilting of said clip and bracket assembly during operation.

3. The apparatus according to claim 1 wherein said upstanding bracket flange comprises a first arm of an L-shaped bracket with the bottom arm coupled to the medial region of said bottom portion of said clip and bracket assembly.

4. The apparatus according to claim 1 wherein said upstanding bracket flange has at least one aperture located on said surface for accommodating a suitable fastener for securing the same to said slidable channel assembly.

5. The apparatus according to claim 1 wherein said medial region is between ½ to 1 inch in length.

6. The apparatus according to claim 1 wherein said first projection is relatively parallel to said upstanding flange and said second projection is at a transverse downwardly sloping angle with respect to said first projection.

7. The apparatus according to claim 1 wherein said clip and bracket assembly is fabricated from an integral steel sheet material.

8. The apparatus according to claim 3 wherein said bottom arm of said L-shaped bracket is coupled to said medial region by means of a fastener.

* * * * *